US006031166A

United States Patent [19]

Petrarca

[11] Patent Number: 6,031,166

[45] Date of Patent: Feb. 29, 2000

[54] STRAP ASSEMBLY FOR SUPPORTING AN INSTRUMENT ON A PERSON'S BODY

[76] Inventor: Anthony I. Petrarca, 1462 Felton Rd., South Euclid, Ohio

[21] Appl. No.: 09/260,476

[22] Filed: Mar. 1, 1999

[51] Int. Cl.[7] ..... G10D 3/00

[52] U.S. Cl. ..... 84/327; 84/267; 84/453

[58] Field of Search ..... 84/327, 267, 453

[56] References Cited

U.S. PATENT DOCUMENTS

| | | | |
|---|---|---|---|
| 3,665,490 | 5/1972 | Oskar | 381/169 |
| 3,763,736 | 10/1973 | Williams . | |
| 3,781,451 | 12/1973 | Nolan | 84/723 |
| 4,232,582 | 11/1980 | Diamond | 84/267 |
| 4,291,822 | 9/1981 | Simonds . | |
| 4,433,603 | 2/1984 | Siminoff | 84/726 |
| 5,149,905 | 9/1992 | Count . | |
| 5,211,321 | 5/1993 | Rodriguez . | |
| 5,245,128 | 9/1993 | Araiza | 84/626 |
| 5,503,315 | 4/1996 | Ruzika et al. . | |
| 5,732,860 | 3/1998 | Faraj . | |
| 5,774,338 | 6/1998 | Wessling, III . | |

*Primary Examiner*—Robert E. Nappi
*Assistant Examiner*—Kim Lockett
*Attorney, Agent, or Firm*—Malloy & Malloy, P.A.

[57] ABSTRACT

A strap assembly designed to support a musical instrument or other electrically powered device on a person and including a body having an elongated configuration including a hollow interior extending along at least a majority of the length of the body, wherein a plurality of electronic components are designed and structured to enhance, supplement and/or transmit the sound or other output from the supported instrument or device. The body includes a plurality of access openings disposed in aligned relation to at least some of the plurality of electronic components so as to provide access thereto by the person on which the support strap and instrument are mounted so as to facilitate operative manipulation of the components during operation of the supported instrument. A connector assembly comprises a plurality of exteriorly and interiorly accessible input/output connectors disposed and configured to facilitate electrical interconnection between certain ones of the various electronic components and the instrument as well as a microphone or other devices.

24 Claims, 5 Drawing Sheets

STRAP ASSEMBLY FOR SUPPORTING AN INSTRUMENT ON A PERSON'S BODY

BACKGROUND OF THE INVENTION

1. Field of the Invention

This invention relates to a strap designed to be removably mounted about the body of a person and be attached in supporting relation to a musical instrument or other electrically powered object wherein the support strap either removably or permanent supports a plurality of electronic components which may include a battery or like power supply. The electronic components are electrically connected to the musical instrument or other object being supported and are cooperatively structured to enhance supplement and/or transmit the sound or output generated by the instrument.

2. Description of the Related Art

The playing of musical instruments particularly on a professional level typically involves the use of electrically powered amplifiers, synthesizers and a variety of other electronic components specifically designed to enhance, transmit, amplify or otherwise favorably affect the sound generated by the one or more instruments being played. Accordingly, a proper interconnection and/or activation of such electronic component necessarily involves a certain amount of "set-up" time immediately before and to a somewhat lesser extent, immediately after performance or the playing of such instruments. However, in the music or entertainment industry particularly in situations involving the successive appearance of a plurality of different performers, there is a minimal amount of "set-up" time allowed to the individual performers for accomplishing the arrangement and/or activation of their instruments and associated electronic components of the type set forth above. Accordingly, the ability to reduce the time required for instrument set-up would be highly advantageous to professional musicians and desirable to amateur musicians as well.

In order to overcome the problems of the type set forth above numerous electronic components specifically designed for the amplification, transmission or general enhancement of the sound generated by musical instruments have been miniaturized. Such microminiaturization of electronic circuit and/or components has greatly reduced problems and disadvantages associated with musical instrument arrangements and set-up by reducing and/or eliminating the physical effort as well as significantly reducing the time associated with the handling of the regular sized speakers, amplifiers, etc. The ability to carry or support a variety of electronically powered devices directly on a person's body is a well recognized advantage of such miniaturized electronic products or components. In fact, portability is a primary factor in motivating the design and manufacture of miniaturized electronic components and circuits. The efficiency with which such electronic components now operate allows components such as radios, wireless or cellular telephones, compact disk or tape players, televisions, etc., to be fully portable and further allows various electronic components such as of the type set forth above to be carried on the person or clothing of a user. In accomplishing such portability, miniaturized components are removably supported on the body of a user through the design of specialized garments such as but not limited to vests, jackets, belts, etc. which include a plurality of pockets or compartments in which various, components including batteries as well as electronic circuits and innerconnecting conductors are mounted. Such garment like structures are intended to provide a fashionable or aesthetically pleasing appearance, as well as having the functional characteristics of supporting a variety of such electronic components.

While known or contemplated garment like structures of the type set forth above are assumed to be operative for their intended function, none of such garments are specifically adapted for the removable support of a conventional, electrically powered musical instrument, such as but not limited to a guitar on the body of a musician. As is well known, the playing of a guitar typically involves the use of a removably attached support strap which is draped about the shoulders of the musician, wherein opposite ends of the support strap are attached to spaced apart portions of the guitar or other instrument being played.

Accordingly, there is a recognized need in the music industry for an improved assembly which incorporates a plurality of miniaturized electronic components designed and structured to facilitate the connection or "set-up" of one or more musical instruments by reducing or eliminating the set-up time normally associated with the professional performance of musical instruments on a stage or like area. In addition, any such improved, assembly should be comfortably mounted on the musician in a manner which positions the electronic components as well as associated conductors or cables in an out-of-sight location and therefore does not detract from his playing ability or derogatorily affect his appearance or dress, such as by requiring the wearing of large, generally bulky and often times unattractive garments to carry such electronic components.

SUMMARY OF THE INVENTION

The present invention relates to a strap assembly primarily designed to be removably attached to an electronic musical instrument such as but not limited to a guitar or the like and which is dimensioned and configured to be positioned in a draped fashion generally about the shoulders of a player or musician in a somewhat conventional orientation. It is emphasized, however, that the support strap assembly of the present invention can be utilized to removably mount or support a variety of other devices, other then musical instruments, in an operable position on a user's body. Accordingly, the strap assembly of the present invention comprises an elongated body having a hollow interior portion extending along at least a majority of the length thereof. The body includes opposite ends structured to be removably connected to spaced apart portions of the musical instrument in a somewhat conventional fashion. In addition, one or both of the opposite ends may include an extension structure designed to be attached at various locations along its length to the correspondingly positioned and cooperatively structured connector conventionally secured to the instrument being supported. Such an extension structure is utilized to accommodate players or musicians of various sizes by effectively regulating the operative length of the support strap.

The body of the strap assembly of the present invention and particularly the hollow interior thereof is sized and configured to house a plurality of miniaturized electronic components of the type which are commercially available or customized to accomplish specific operational characteristics and which are designed to transmit, amplify or otherwise enhance or supplement the sound generated by the supported musical instrument. In addition, such electronic components may include a multi-effects processor or like device, as well as an electrical power supply such as but not limited to a rechargeable battery pack and appropriate electronic circuitry including electric conductors, for the interconnection of appropriate ones of the plurality of electronic components, as a switch assembly. The switch assembly may include an on/off switch as well as one or more additional switches which are structured to allow a person to regulate current flow from the battery pack to the various electronic components as desired.

The body of the strap assembly of the present invention further comprises a plurality of access openings each preferably disposed in aligned, communicating relation with at least one of the plurality of electronic components. The plurality of access openings are dimensioned, disposed and configured to allow the person, on which the instrument is supported, to have free and easy access to the various components for purposes of physical handling or manipulation thereof in order to properly activate or operate such components in order to enhance the performance and/or sound generation of the supported instrument. In addition, the strap assembly of the present invention comprises a connector assembly which includes a plurality of input or output connectors mounted on a sidewall of the body and being exteriorly accessible so as to facilitate the connection of input plugs or jacks utilized to electrically connect the instrument as well as other auxiliary items, such as but not limited to a microphone, head phone, ear phone, etc. to the electronic components maintained within the hollow interior of the body. One or more input/output connectors may also be located on the interior of the body so as to allow for custom wiring or selective interconnection or existing components or the inclusion of additional components or devices.

Therefore, it is a primary object of the present invention to provide a strap assembly dimensioned and configured to be positioned on the body of a person in a somewhat conventional position and to be attached in supported engagement with a musical instrument or other electrically powered device, wherein a plurality of electronic components designed to enhance and/or supplement the sound or output generated by the supported instrument or device are mounted and operatively positioned on the strap assembly.

Another primary object of the present invention is to provide a strap assembly for removably supporting a musical instrument or like device on the body of a person in a manner which does not detract from the appearance, comfort or playing capabilities of the person.

Yet another important object of the present invention is the provision of a strap assembly designed to removably support an electrically powered musical instrument or like device on the body of a player, which includes the mounting of a plurality of miniaturized electronic components designed to enhance the instrument's output, in an out-of-sight but operatively accessible location.

It is also an important object of the present invention to provide a strap assembly for the removable support of a musical instrument or like device on the body of a person, wherein the strap assembly includes a housing for the mounting of a plurality of electronic components within a hollow interior thereof and further wherein the body is structured to provide operative access to the various components during playing of the instrument or operation of the device being supported.

Yet another object of the present invention is the provision of a strap assembly designed to removably support an electrically powered musical instrument or like device in an appropriate location on a user's body and which carries a plurality of electronic components designed and structured to enhance and supplement the output of the musical instrument or device, wherein the electronic components may include a portable power supply and an associated switch assembly for respectively supplying power and regulating current flow to the various electronic components, the supported instrument and other devices during periods of use and non-use.

Still another primary object of the present invention is the provision of a strap assembly comprising a plurality of electronic components removably or permanently mounted on the interior thereof, wherein the components include electrical conductors interconnecting such components and inlet/outlet connectors for electrically connecting a variety of auxiliary devices such that a user may appropriately customize a musical instrument set-up to include a personalized choice of accessories in order to best accomplish the operation and performance of the instrument being supported.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
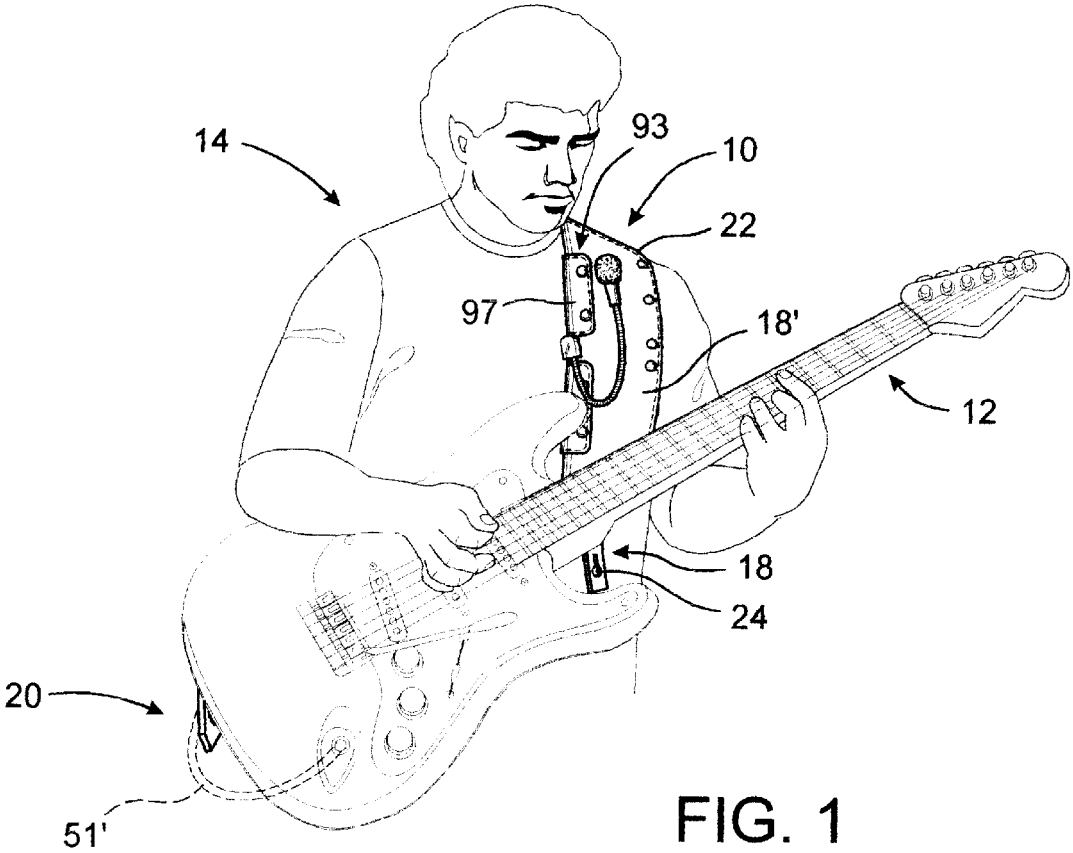
FIG. 1 is a perspective view of a preferred strap assembly in accordance with the present invention, used to removably support a musical instrument in an intended, operative position on a user's body.

As shown in the accompanying drawings, the present invention relates to a strap assembly generally indicated as 10 designed to removably support a musical instrument, generally indicated as 12, in an appropriate location on the body or person of a player, generally indicated as 14. As shown in FIG. 1, the strap assembly 10 includes a body 22 removably attached at the opposite ends 18 and 20 to spaced apart portions of the musical instrument 12. The body 22 may be formed of a variety of different materials, such as but not limited to, leather, vinyl, plastic, etc. and may have padding mounted thereon at appropriate locations to assure a comfortable support on the user's body. In the orientation shown in FIG. 1, the end 18 may be considered a leading end of the body 22 and the oppositely disposed end 20 may be considered a rear or trailing end. Accordingly, in the preferred or normal position of the strap assembly 10, a leading portion 18' of the body 22 is disposed in overlying relation to what may be considered the front of the musician or player 14. The rear or trailing end 20 and a length of the body 22 generally disposed adjacent to the end 20 is disposed in somewhat overlying relation to a back portion of the player 14. It should further be emphasized that while the strap assembly 10 of the present invention is disclosed as supporting a musical instrument 12, generally in the form of an electrically powered guitar, other musical instruments or devices other than musical instruments could also be removably supported on a users body in an intended, operative position without departing from the intended spirit and scope of the present invention.

Figure 3:
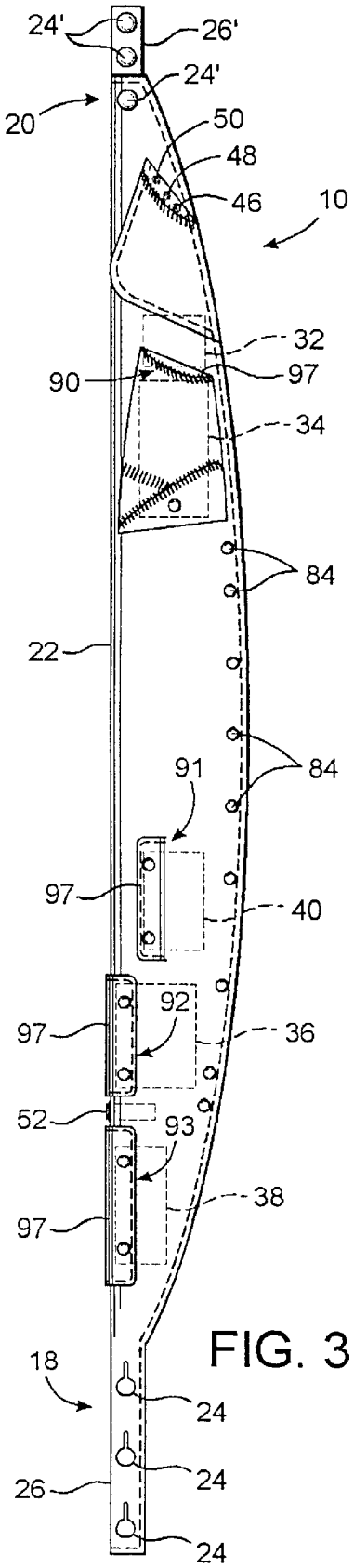
FIG. 3 is a front plan view of an outer front surface of the strap assembly of the embodiment of FIG. 1.
Figure 4:
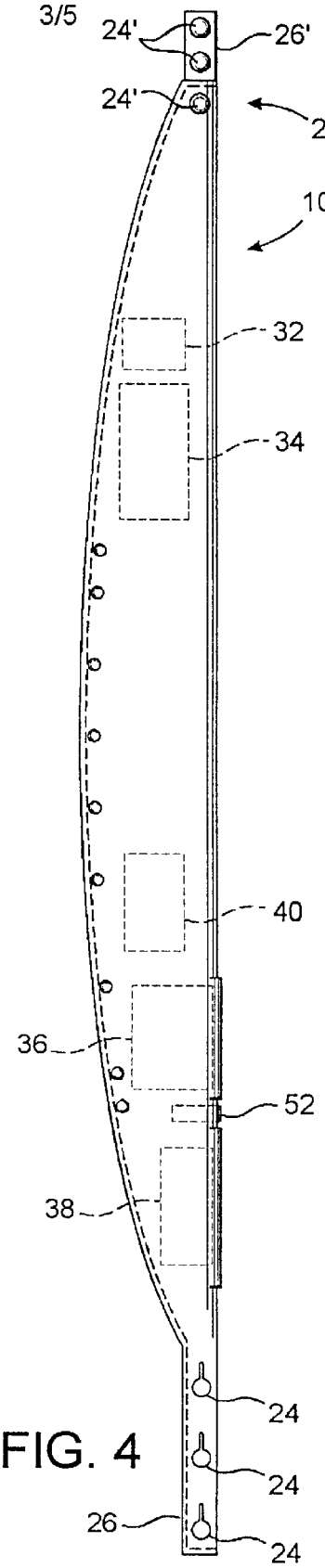
FIG. 4 is a front plan view of a rear surface of the embodiment of FIG. 3.
Figure 5:
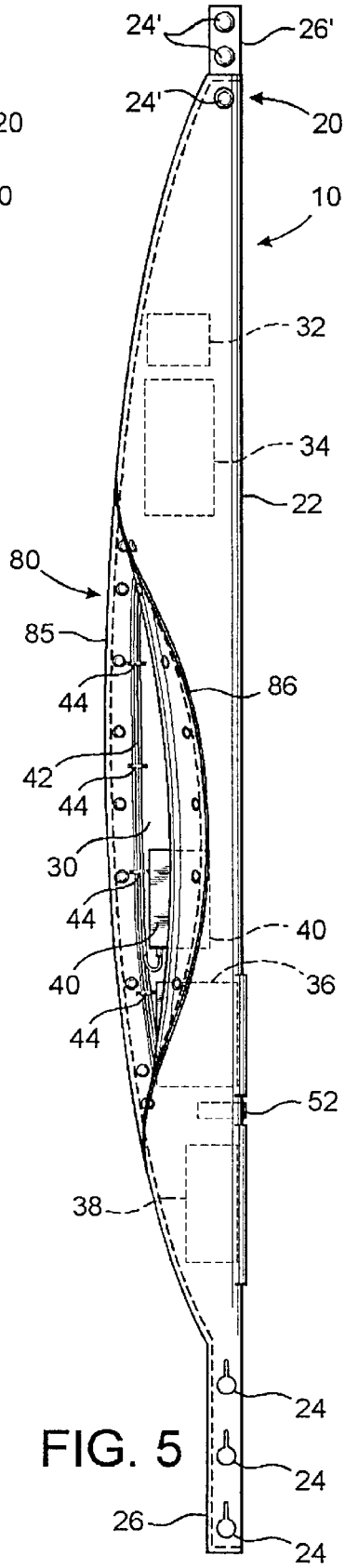
FIG. 5 is a front plan view of the embodiment of FIG. 4 showing interior portions of the strap assembly of the present invention.

Further with regard to FIGS. 3 through 5, each of the opposite ends 18 and 20 includes attachment structures such as apertures 24 and 24' specifically designed and configured to be removably connected to correspondingly disposed and cooperatively configured connectors mounted on or attached to the instrument 12. In addition, at least one but preferably both of the opposite ends 18 and 20 include an extension structure 26 and 26' each having an elongated configuration and comprising a plurality of the aforementioned apertures or connecting structures 24 or 24' respectively, disposed in spaced relation to one another along the length of the respective extension structure 26 and 26'. As shown in FIGS. 3 and 4, extension structure 26 is preferably connected to the front or outer surface of body 22 and the extension structure 26' is preferably connected to the rear or under surface of body 22. The correspondingly positioned connector members mounted on the instrument 12 may be connected to any one of the plurality of apertures 24 or 24' thereby effectively regulating the operative length of the body 22 of the strap assembly 10 in order to accommodate players 14 of varying heights or sizes.

As set forth above, the body 22 has an elongated configuration and is specifically structured to include a hollow interior 30 extending along at least the majority of the length of the body 22. The hollow interior 30 is specifically designed, dimensioned and configured to either permanently or removably contain a plurality of electronic components and interconnecting electric conductors or cables partially represented in phantom lines in FIGS. 3 through 5 and represented schematically in FIG. 6. More specifically, the electronic components may include miniaturized components which may be customized for a specific application or are known and commercially available under a variety of different trademarks or trade names. By way of example, and with reference to FIG. 6, the electronic components may include a microphone transmitter 32, a guitar or instrument transmitter 34, an amplifier 36 and a synthesizer, multi-effects processor or like electronic component 38. The amplifier 36 may be of the type commercially known as the "ATILLA THE AMP™" GA-900. The multi-effects processor 38 may be of the type commercially known as the "PANDORA'S BOX™" and/or "ZOOM 9002™", etc. The "PANDORA'S BOX" may also be considered as a separate musical instrument in that as a multi-effects processor and combined synthesizer, this component is capable of generating sounds which serve as an accompaniment to the sounds generated by the supported guitar or like instrument. The transmitters 32 and 34 may be equivalent devices or may vary by model or manufacturer dependent on the individual preference of the user.

In addition, a rechargeable battery pack as at 40 may be mounted within the hollow interior 30 of the body 22 and defines the supply of electrical energy which powers others of the plurality of electronic components 32, 34, 36, 38 etc. It should be noted that the rechargeable battery pack 40 may also be use to power the supported instrument 12 and/or the auxiliary devices such as the microphone 60, which will be described in greater detail hereinafter. Further with regard to FIG. 6, a switch assembly is indicated as 41 and includes an on/off switch (not shown) structured to regulate current flow between the battery pack 40 and the remainder of the electronic components 32, 34, 36 and 38, as well as the supported instrument 12 and the microphone 60 or other auxiliary device if powered by the battery pack 40. The switching assembly 41 may also include a plurality of other switches, in addition to the on/off switch, wherein such plurality of other switches may be individually disposed and structured to regulate electrical interconnection between various individual ones of the plurality of components and/or between such components and supplementary or auxiliary devices which may be electrically connected to the plurality of components 32, 34, 36, and 38 in order to provide a preferred, enhanced or customized sound when playing the musical instrument 12.

Figure 8:
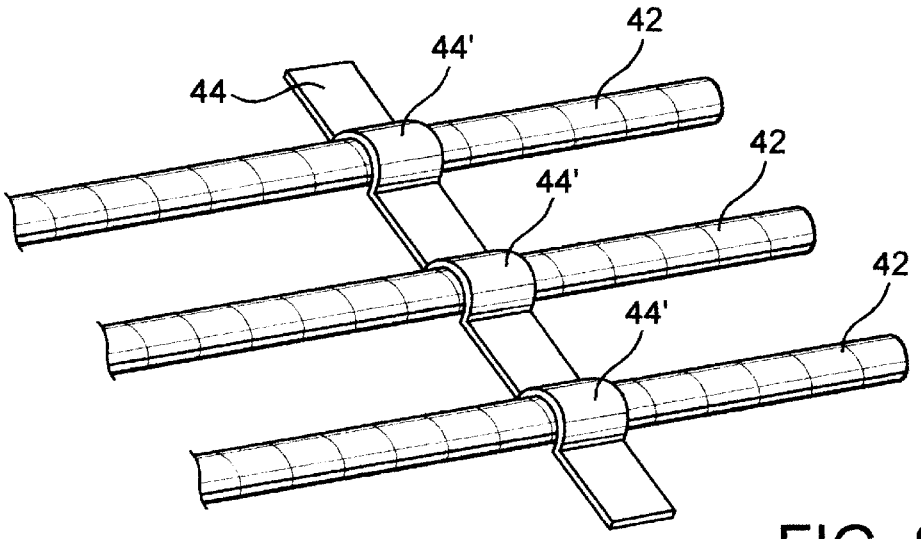
FIG. 8 is a detailed view in perspective and partial cutaway of certain structural features of the embodiment of FIG. 5.

The various electronic components are electrically connected to the power supply 40 by a plurality of cables or electrical conductors 42. In order to avoid unsightly positioning of such conductors, they are mounted within the hollow interior 30 and maintained in an organized, side-by-side relation to one another by a plurality of spaced apart retainers 44 each having spaced apart receiving channels 44' as generally represented in FIG. 5 and shown in detail in FIG. 8. The conductors 42, by virtue of the configuration and placement of the retainers 44, may be permanently or removably disposed in a somewhat side-by-side relation to one another in order to avoid the conductors 42 from collecting together in an unsightly and uncomfortable "bunched" or stacked array. Further, it is emphasized that conductors 42 are preferably multi-line conductors which allows interconnection of a plurality of the electronic components as well as interconnection to other devices such as an additional instrument being played by an accompanying musician. Also the conductors 42 may include antenna structure for the wireless operation of the transmitters 32 and 34. In that both analog and digital devices or components are being used, separate ground wires are provided for each of the plurality of conductors 42. It is of course recognized that the transmitters 32 and 34, in certain embodiments may include their own separate antenna.

Figure 6:
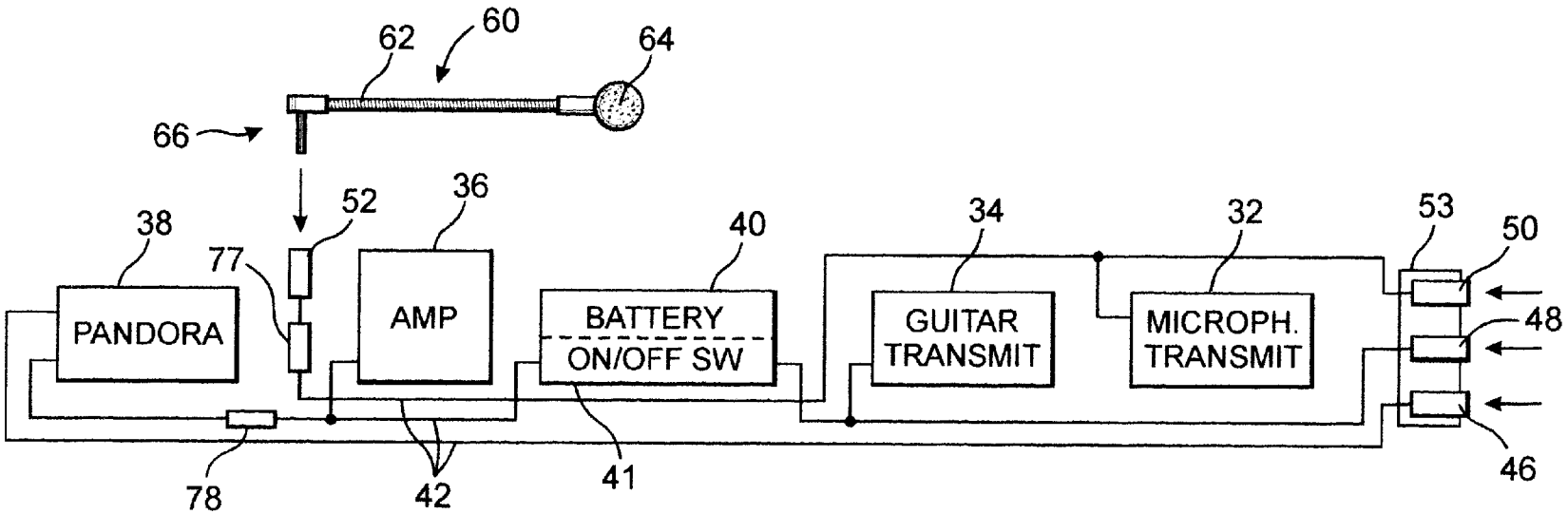
FIG. 6 is a schematic representation of a plurality of electronic components, electrical conductors and/or electronic circuitry which is representative of the electronic components capable of being mounted on the strap assembly of the present invention.
Figure 7:
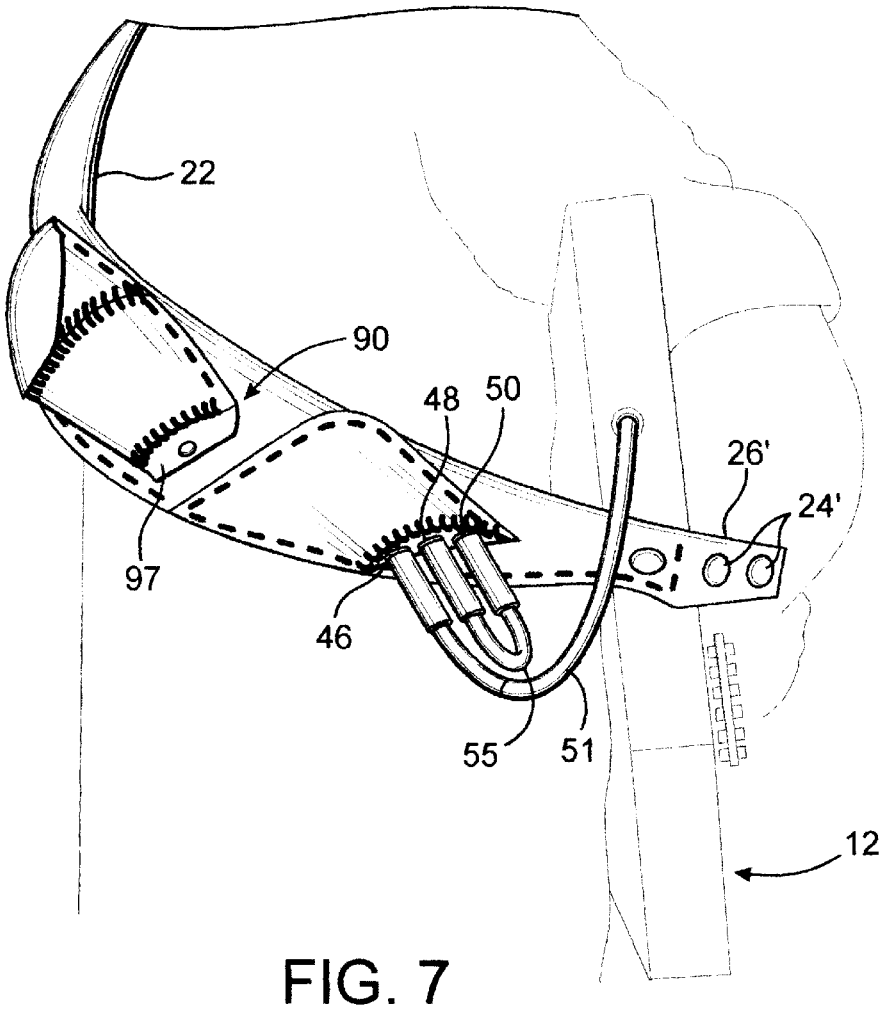
FIG. 7 is a rear perspective view in partial cutaway of portions of the strap assembly illustrating an electrical connection to a supported instrument.

With further reference to FIG. 6, the present invention includes a connector assembly including a plurality of inlet or outlet connector structures 46, 48 and 50. In a preferred embodiment, connector structures 46, 48 and 50 comprise female input connectors designed to receive an exteriorly applied male, plug-type connector. More specifically, input 46 may be used to receive a direct connection from the instrument 12 by a conductor 51 for electrical interconnection to the various components maintained within the hollow interior 30 of the body 22. Input connectors 48 and 50 may be electrically connected to one another by a specialized conductor 55 specifically structured to accomplish electrical interconnection of the instrument 12 to the one or more of the electronic components as set forth above. As shown in FIG. 7, conductor 55 may electrically connect the instrument 12, by means of its attachment to the input 46, to the plurality of electronic components as set forth above and particularly to the instrument transmitter 32 maintained within the hollow interior 30. It is emphasized that the connector assembly including the various input output connectors 46, 48, 50 and 52 may be structurally adapted to accomplish a mono and/or stereo set-up as desired. It should be further noted that in one preferred embodiment, the plurality of connectors 46, 48 and 50 may be part of a bus box 53 structured to mount the various connectors 46, 48 and 50 in a specific exteriorly accessible location on a sidewall of the body 22. As shown in FIG. 1, the guitar 12 may include an input/output connector structure 57 on the front face thereof for attachment to conductor 51' rather than on the rear end portion 12' as shown in FIG. 7. The location of the attachment for an interconnecting conductor such as 51 or 51' may vary dependent on the make or model of the guitar 12 or other supported instrument.

Figure 2:
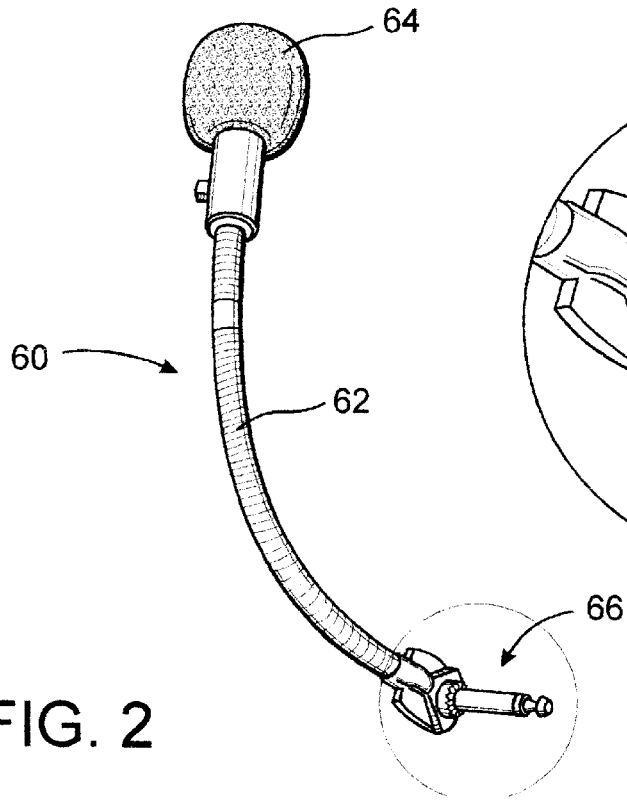
FIG. 2 is a perspective view of a microphone device which may be attached to the strap assembly of the present invention and selectively positioned relative to the player as generally shown in the embodiment of FIG. 1.
Figure 2A:
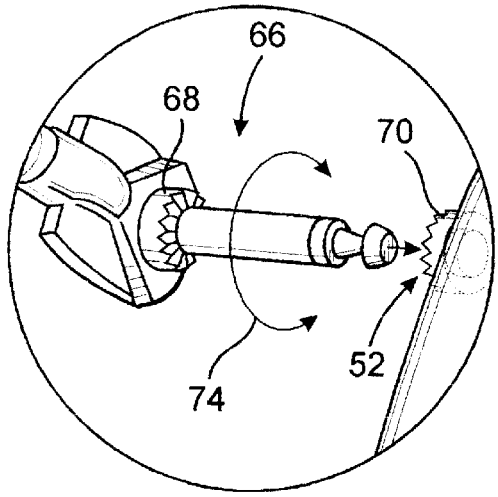
FIG. 2A is a detailed view of a portion of the structure of FIG. 2.

Another feature of the present invention is the provision of the connector assembly including an auxiliary inlet/outlet connector structure 52 preferably being exteriorly accessible and designed to receive and establish electrical connection between an auxiliary instrument or device such as, but not limited to a headphone, ear phone, or microphone 60 and the transmitter 32. As shown in FIG. 2A, microphone 60 has a semi-rigid but adjustable "goose-neck" support portion 62 having an elongated configuration with the microphone head 64 secured to one end thereof. As an alternate structure the support portion 62 could be in the form of an adjustable elbow member, not shown for purposes of clarity. To accomplish selective and preferred positioning of the microphone head 64 relative to the mouth of a musician a male type plug generally indicated as 66 may include one end comprising a substantially irregular surface 68. As shown in detail in FIG. 2A, the end 68 comprises a plurality of alternating ridges and grooves. This irregular surface 68 is designed to removably and adjustably mate with surface 70 of the exteriorly accessible input/output connector 52 referred to above. As the male plug 66 is inserted into the female connector 52, the exterior surfaces 68 and 70, both of which have a corresponding irregular configuration, mate with one another. The alternating ridges and grooves defining the irregular surfaces 68 and 70 will allow for a selected and incremental adjustment of the position of a microphone 60 when the male plug 66 is rotated in either direction as indicated by directional arrow 74. Therefore, the position of the microphone 60 and specifically the head 64 of the microphone may be selectively positionable, in increments into the appropriate position relative to the player's mouth as desired.

Figure 2B:
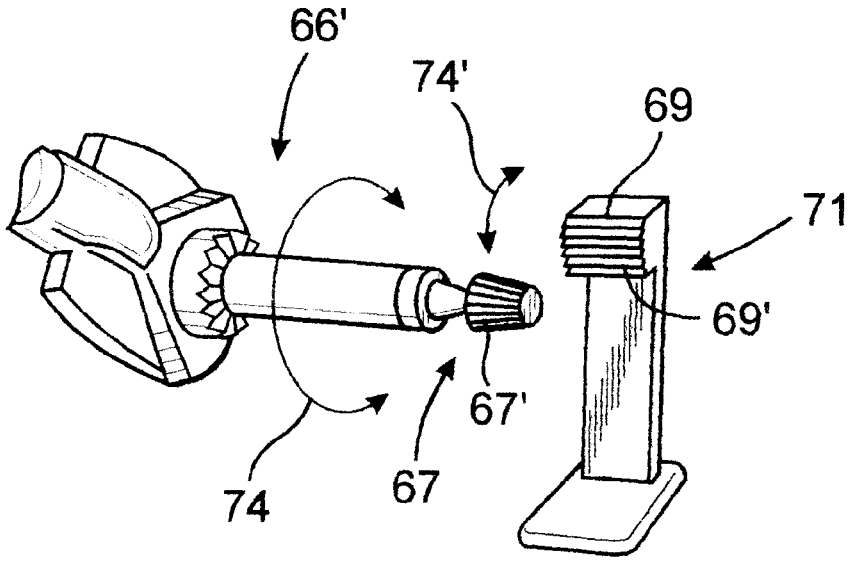
FIG. 2B is a detailed view of an alternate embodiment of the structure of FIGS. 2 and 2A.

As an alternate embodiment the selective, incremental positioning of the microphone 60 or other externally connected device as set forth above, may be accomplished by incorporating the structure of FIG. 2B. More specifically, the male plug member 66' has an irregular surface configuration 67' formed on the outer most head portion as at 67, wherein the irregular surface configuration 67' may also be defined by a plurality of successively disposed ridges and grooves. The head 67 of the male plug member 66' is disposed to removably but matingly engage a correspondingly configured and disposed head portion 69 of the contact member 71. The contact member 71 may be constructed to include an inherent spring bias which normally forces an irregular surface 69' of portion 69 into removable mating engagement with the surface 67' of the head 67 as indicated by directional arrow 74'. The respective irregular surfaces 67' and 69' both comprise alternating ridges and grooves and when forced into mating engagement with one another will allow the user to move the microphone 60 or other device, in an incremental manner upon rotation of the plug 66' in either direction as indicated by directional arrow 74. The microphone 60 can be thereby be incrementally adjusted into a preferred position relative to the user's mouth.

Figure 2C:
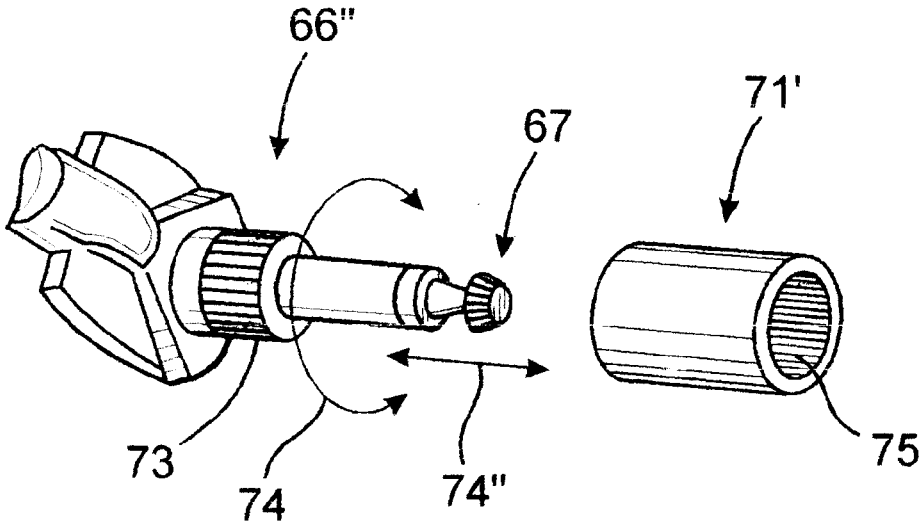
FIG. 2C is a detailed view of yet another alternate embodiment of the structure of FIGS. 2 and 2A.

Yet another embodiment of the present invention is shown in FIG. 2C and comprises the male plug member 66" having an irregular surface 73 formed along its length, which is defined by the aforementioned alternating ridges and grooves. The male member 66" is intended to cooperate with and be inserted through the contact member 71', preferably having an annular configuration and an inner surface 75 including the aforementioned irregular configuration comprising a plurality of alternating ridges and grooves. The surface 75 is dimensioned and configured to removably mate with the irregular surface 73 of the male member 66". As the male plug 66" is inserted into the input/output connector 52 and subsequently through the contact member 71', the irregular surface configurations 73 and 75 mate with one another. The respectively disposed alternating ridges and grooves defining the irregular surfaces 73 and 75 will allow for a selected, incremental adjustment of the position of the microphone 60, or other device, when the male plug 66" is rotated relative to the contact 71' as represented by directional arrow 74. However, the plug 66" must first be partially withdrawn, prior to rotation as indicated by directional arrow 74".

In addition to the auxiliary inlet/outlet connector 52, the connector assembly may further comprise one or more interiorly disposed, in-line connectors as at 77 and 78 in FIG. 6. While being disposed within the interior 30 of the body 22, the in-line connectors 77 and 78 may be readily accessible to a user of the strap assembly 10 by means of appropriately positioned access openings or alternately through the primary opening generally indicated as 80 and described in greater detail hereinafter with reference to FIG. 5. The in-line connectors 77 and 78 are disposed in electrical connection, by means of appropriately disposed conductors 42, with the connector structure 52 and/or with one or more of the electronic components as clearly shown in FIG. 6.

Other features of the present invention are best shown in FIGS. 3 through 5 and include the body 22 having a primary opening generally indicated as 80. The primary opening may extend along the length of the hollow interior 30 and accordingly along at least the majority of the length of the body 22. The disposition and dimension of the primary opening allows complete access to the interior 30 of the body 22 as well as the plurality of electronic components contained therein. Accordingly, customized wiring and interconnection between the various electronic components and other operations may be performed within the hollow interior 30 in an easy and effective manner, when the primary opening 80 is opened, allowing for exposure of the hollow interior 30 and the contents thereof. Closure structures such as but not limited to snap type connectors 84 may be attached to the opposite peripheries 85 and 86 of the primary opening 80 and serve to removably open or close the primary opening 80 as shown. It is to be emphasized that closure structures other than snap-fit connectors may be utilized to accomplish the selective opening or closing of the peripheral portions of the primary opening 80. Such other closure structures may include but are not limited to zippers, hook and loop type fasteners, etc.

Yet another feature of the present invention is the inclusion of a plurality of access openings generally indicated as 90, 91, 92, and 93. each of which may be covered by a movably mounted flap or like closure member, which for purpose of clarity are all indicated as 97 and which are each appropriately dimensioned, configured and positioned relative to one of the access openings 90, 91, 92, and 93 as best shown in FIG. 3. Further, one or more of the flaps or like closure members 97 may include one or more apertures for the free and simple access to portions of the electronic components. More particularly, the aforementioned current regulating on/off switch which may be associated with the switch assembly 41 is thereby made readily accessible. Manipulation of the on/off switch may be accomplished by a toggle member extending through an aperture in an appropriately positioned flap 97. Such an apertured construction of the one or more flaps 97 will alleviate the need to remove the flap and position it in an open position. Each of the plurality of access openings 90, 91, 92, and 93 are preferably disposed in aligned accessible relation with at least one of the plurality of electronic components 32, 34, 36, 38 and 40 and each of the plurality of access openings 90, 91, 92, and 93 are dimensioned and configured to allow the passage of at least one hand of the musician 14 in communicating relation with the correspondingly positioned and aligned electronic component. It is preferred that the access openings also have a sufficiently large dimension to allow insertion and removal of a correspondingly positioned component therethrough, when such is required. In this fashion, the musician or player 14 may manipulate the individual ones of the electronic components to cause their activation or to regulate their operation as desired. As best shown in FIG. 1, certain ones of the access openings as at 93 may be disposed along the leading length 18' of the body 22 adjacent to the leading end 18 and disposed in overlying relation to a front area or portion of the player so that access to the electronic components, such as the multi-effects processor 38 amplifier 36, in-line connectors 77 and 78 and/or the switch assembly 41 associated with battery 40, is facilitated. The other electronic components may be situated appropriately, relative to at least one of the access openings, so as to facilitate access thereto.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A strap assembly designed to removably support a musical instrument on a person, said assembly comprising:

a) a body having an elongated configuration terminating at oppositely disposed ends and including an at least partially hollow interior, b) each of said opposite ends removably attachable to spaced apart portions of the musical instrument, c) a plurality of electronic components mounted within said hollow interior, said electronic components electrically interconnected to one another and to the musical instrument and collectively structured to enhance instrument generated sound, d) at least one access opening formed in said body in aligned relation with at least some of said plurality of electronic components, and e) said one access opening sufficiently dimensioned to allow operative access to aligned ones of said plurality of electronic components.

2. An assembly as recited in claim 1 further comprising a connector assembly mounted on said body at least partially within said hollow interior and secured to a sidewall of said body so as to be exteriorly accessible thereon.

3. An assembly as recited in claim 2 wherein said connector assembly includes an instrument input/output connector structured for electrical connection to the instrument and being electrically interconnected to said plurality of electronic components.

4. An assembly as recited in claim 2 wherein said connector assembly includes an auxiliary input/output connector structured for electrical connection to an externally disposed auxiliary device and being electrically interconnected to said plurality of electronic components.

5. An assembly as recited in claim 1 wherein said connector assembly includes an instrument input/output connector disposed and structured for electrical connection to the instrument and being electrically interconnected to said plurality of electronic components.

6. An assembly as recited in claim 5 wherein said connector assembly comprises a plurality of input/output connectors structures each electrically interconnected to predetermined ones of said plurality of electronic components.

7. An assembly as recited in claim 5 further comprising a plurality of elongated conductors mounted within said hollow interior and disposed in interconnecting relation with said plurality of electronic components and said connector assembly.

8. An assembly as recited in claim 1 further comprising a plurality of elongated conductors mounted within said hollow interior and disposed in interconnecting relation with said plurality of electronic components.

9. An assembly as recited in claim 1 further comprising a primary opening formed in said body and extending substantially along said hollow interior and disposed in communication therewith, said primary opening dimensioned to allow passage of said plurality of electronic components therethrough into and out of said hollow interior.

10. An assembly as recited in claim 9 further comprising a closure assembly mounted on said body adjacent said primary opening and cooperatively structured therewith to removably secure said primary opening in a closed position.

11. An assembly as recited in claim 9 wherein said hollow interior comprises an elongated configuration extending along at least a majority of the length of said body, said plurality of electronic components disposed in spaced relation to one another along the length of said hollow interior.

12. An assembly as recited in claim 11 further comprising a plurality of access openings formed in said body in aligned relation with at least some of said plurality of electronic components, said plurality of access openings each being sufficiently dimensioned to allow operative access to correspondingly positioned ones of said plurality of electronic components.

13. An assembly as recited in claim 12 wherein said body is dimensioned and configured to extend over a shoulder portion of the person in supporting attachment to the instrument; a first of said opposite ends disposed in substantially overlying relation to the person's frontal area; at least one of said plurality of electronic components and a correspondingly positioned aligned one of said plurality of access openings disposed adjacent said first opposite end and in substantially overlying relation to the person's frontal area.

14. An assembly as recited in claim 13 further comprising a second of said opposite ends disposed in overlying relation to a person's back area and at least one of said plurality of electronic components and a correspondingly positioned aligned one of said access openings disposed adjacent said second opposite end and in substantially overlying relation to the person's back area.

15. An assembly as recited in claim 14 further comprising a connector assembly mounted on said body at least partially within said hollow interior and secured to a sidewall of said body so as to be exteriorly accessible thereon; said connector assembly including an instrument input/output connector electrically connected to the instrument and being electrically interconnected to said plurality of electronic components.

16. An assembly as recited in claim 1 further comprising a connector assembly including a plurality of input/output connectors mounted in an exteriorly accessible location on a sidewall of said body and electrically interconnected to said plurality of components, each of said input/output connectors disposed to receive an exteriorly applied connector.

17. An assembly as recited in claim 16 wherein one of said plurality input/output connectors is configured to receive an adjustable male connector, said one input/output structure and said adjustable male connector each comprising a mating surface disposed in confronting engagement with one another when said one input/output connector and said adjustable male connector are attached to one another; each of said mating surfaces including a predetermined irregular configuration cooperatively structured to selectively alter positions of said exteriorly applied connector relative to said one input structure.

18. An assembly as recited in claim 17 wherein said predetermined irregular configuration comprises each of said mating surfaces including alternating ridges and grooves cooperatively disposed to facilitate incremental positioning of said adjustable male connector relative to said one input/output connector.

19. A strap assembly designed to support an electrically activated instrument on a person, said assembly comprising:

a) a body having an elongated configuration and terminating at oppositely disposed ends, said body including an elongate hollow interior extending along at least the majority of the length of said body, b) said body attachable in supporting relation to the instrument substantially at said opposite ends thereof and dimensioned and configured to drape over at least one shoulder portion of the person, c) a plurality of electronic components mounted within said hollow interior, said electronic components electrically interconnected to one another and to the musical instrument and collectively structured to enhance operation and output of the instrument, d) said body including an exterior sidewall comprising a primary opening formed therein an extending along at least the majority of said hollow interior and in communication therewith, e) a plurality of access openings formed in said exterior wall in substantially aligned relation with at least some of said electronic components, and f) said plurality of access openings being dimensioned and configured to allow the person operative access to aligned ones of said plurality of electronic components.

20. An assembly as recited in claim 19 further comprising a connector assembly including a plurality of input/output connectors mounted on said exterior sidewall in an exteriorly accessible location, said plurality of input/output connectors electrically connected to at least some of said electronic components and structured to receive exteriorly applied connectors.

21. An assembly as recited in claim 20 wherein one of said plurality of input/output connectors is configured to receive an adjustable male connector, said one input/output connector and said adjustable male connector each comprising a mating surface disposed in confronting, engagement with one another when said one input/output connector and said adjustable male connector are attached to one another; each of said mating surfaces including a predetermined irregular surface configuration cooperatively structured to selectively and incrementally position said one adjustable male connector relative to said one input/output connector.

22. An assembly as recited in claim 19 further comprising an elongate extension structure formed on at least one of said opposite ends and including a plurality of spaced apart attachment portions extending along the length thereof, each of said plurality of attachment portions removably connectable to the instrument, whereby the effective length of said body may be varied to accommodate the size of the person.

23. An assembly as recited in claim 19 wherein at least one of said electronic components comprises a supply of electrical energy and is connected to others of said plurality of electronic components and further including a switch assembly disposed to regulate current flow between said supply of electrical energy and the others of said plurality of electronic components.

24. An assembly as recited in claim 23 wherein said connector assembly further comprises at least one in-line connector mounted within said hollow interior and electrically connected in an in-line relation to at least one of said plurality of input/output connectors mounted on said exterior sidewall of said body.

* * * * *